United States Patent [19]

Hoffman

[11] Patent Number: 4,686,797

[45] Date of Patent: Aug. 18, 1987

[54] STRAIGHT-LINE RUBBING MACHINE WITH THRUST TRANSMITTING MEMBERS

[75] Inventor: Roger T. Hoffman, Monroe Center, Ill.

[73] Assignee: National Air Sander, Inc., Rockford, Ill.

[21] Appl. No.: 918,994

[22] Filed: Oct. 15, 1986

[51] Int. Cl.[4] ..... B24B 23/00

[52] U.S. Cl. ..... 51/170 TL; 51/175; 15/22 R

[58] Field of Search ..... 51/170 TL, 170 R, 175; 15/22 R, 22 A

[56] References Cited

U.S. PATENT DOCUMENTS 2,825,188 3/1958 Champayne ..... 51/170 TL 3,577,687 5/1971 Champayne ..... 51/170 TL

*Primary Examiner*—Roscoe V. Parker

*Attorney, Agent, or Firm*—Leydig, Voit & Mayer

[57] ABSTRACT

A rubbing machine of the type in which a support is spaced from and overlies a rubbing shoe and in which the rubbing shoe is connected to the support by a drive mechanism operable to reciprocate the shoe. The rubbing shoe is rectangular in shape with the drive mechanism connected at the center of the shoe, and four flexible boots are connected between the support and the shoe at the corners of the shoe. Four pair of opposed, rigid studs are mounted between the support and the shoe to transmit thrust therebetween, and each pair of studs is mounted within a respective one of the boots with one of the studs connected to the support and one to the shoe. A tongue-and-groove connection between the opposing ends of each pair of studs confines the shoe for linear reciprocation in a straight path.

12 Claims, 5 Drawing Figures

STRAIGHT-LINE RUBBING MACHINE WITH THRUST TRANSMITTING MEMBERS

BACKGROUND OF THE INVENTION

This invention relates to a portable rubbing machine of the type used for sanding or polishing and, more particularly, to a machine in which a support is spaced from and overlies a rectangular rubbing shoe. A drive mechanism is connected between the support and the shoe to drive the latter with a back and forth motion, and a number of flexible boots are connected between the support and the shoe to cause the shoe to move back and forth rather than rotating about the drive mechanism.

A rubbing machine of this general type is disclosed in Champayne U.S. Pat. No. 3,577,687. In the rubbing machine of that patent, the boots are extremely flexible and each houses a pair of relatively movable thrust transmitting members formed by opposing studs. The studs transmit thrust between the shoe and the overlying support so as to relieve the boots of the burden of transmitting the thrust and thereby enable the use of boots which are extremely flexible. The use of very flexible boots significantly reduces the power required to move the rubbing shoe.

The shoe of the rubbing machine of the Champayne patent moves with a gyratory motion. That is, the elongated shoe is moved back and forth in a lengthwise direction and, at the same time, is moved side-to-side. A rubbing machine with a gyratory shoe is preferred for certain operations while, in other applications it is more advantageous to use a rubbing machine having a shoe which reciprocates back and forth along a straight path. A rubbing machine with a reciprocating shoe is disclosed in Champayne U.S. Pat. No. 2,825,188.

SUMMARY OF THE INVENTION

The general aim of the present invention is to provide a new and improved rubbing machine which takes full advantage of flexible boots with thrust transmitting members and which, at the same time, is capable of reciprocating the rubbing shoe back and forth along a straight path.

A more detailed object of the invention is to achieve the foregoing by providing a rubbing machine with novel thrust transmitting members which coact uniquely with one another to confine movement of the rubbing shoe to a straight back and forth path.

Still another object of the invention is to provide a rubbing machine in which a plurality of boots and thrust transmitting members are uniquely located at the corners of the shoe so as to remove virtually all thrust from the drive mechanism of the machine and to reduce wear of the thrust transmitting members.

These and other objects and advantages of the invention will become more apparent from the following detailed description when taken in conjunction with the accompanying drawings.

DETAILED DESCRIPTION OF THE PREFERRED EMBODIMENT

Figure 1:
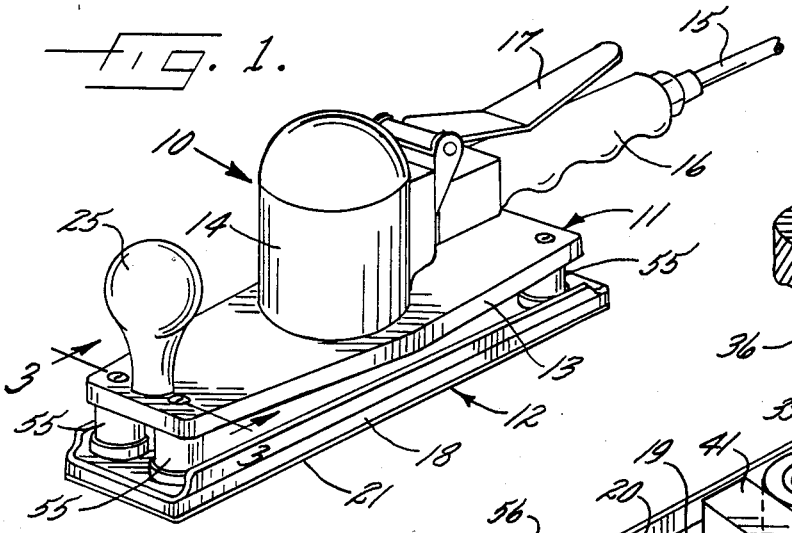
FIG. 1 is a perspective view of a new and improved rubbing machine incorporating the unique features of the present invention.

As shown in the drawings for purposes of illustration, the invention is embodied in a portable rubbing machine 10 (FIG. 1) driven by a rotary motor (not visible) mounted on a frame or support 11 on which an elongated, rectangular rubbing shoe 12 is supported for bodily movement. The support is a horizontal, elongated generally diamond-shaped member with downturned edges 13 and is spaced from and overlies the rubbing shoe. To support and house the rotary motor, a housing 14 is mounted on the support.

To drive the rotary motor, air under pressure is carried to the motor through the housing 14 by a flexible tube 15. To enable the user to grip the rubbing machine and to control the air supply to the motor, a handle 16 is attached to the housing and extends around the tube. Overlying the handle is a lever 17 which is operatively connected to a valve (not shown) so that, by pressing down on the lever, the valve may be opened to operate the motor.

The rubbing shoe 12 comprises a pad 18 (FIG. 3) of yieldable material such as rubber adhesively secured to a metal sheet 19 whose edges 20 are upturned. An abrasive sheet 21 is stretched around the bottom the the pad and is suitably held in place.

To rub a work surface efficiently with the power-driven shoe 12, the shoe must be pressed firmly against the work surface. To accomplish this, the user grips the handle 16 with one hand and a knob 25 mounted at the other end of the support 11 with his other hand. The user then exerts a downward pressure or thrust against the support. This thrust is transmitted to the shoe 12 to press it firmly against the work surface.

In accordance with the present invention, the shoe 12 is reciprocated back and forth by the drive motor and is confined for movement in a straight path by means 30 which also transmit vertical thrust between the support 11 and the shoe at a plurality of spaced points. The thrust transmitting means 30 tend to insure uniform pressure of all portions of the shoe 12 against the work surface and, at the same time, effect advantageous straight line motion of the shoe.

Figure 2:
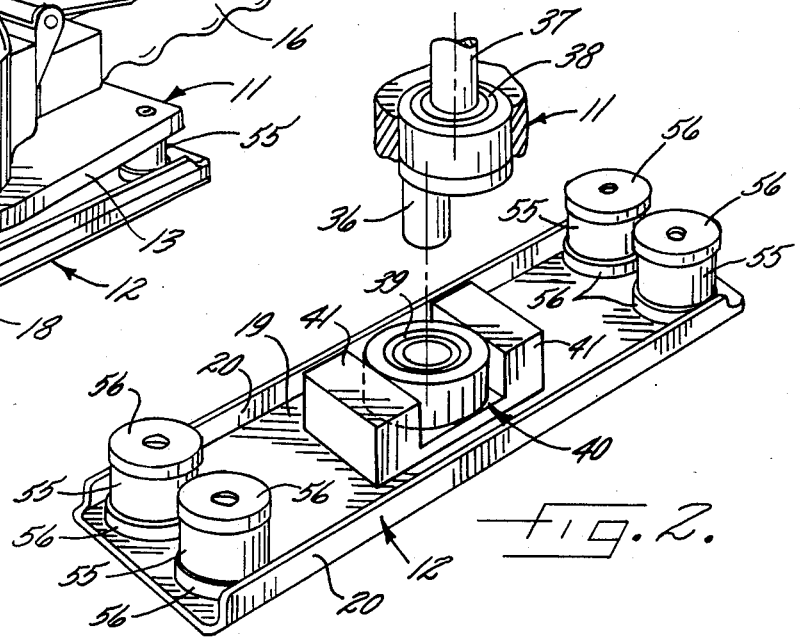
FIG. 2 is an exploded perspective view of certain parts of the rubbing machine.

More specifically, the shoe 12 is reciprocated by a crank or eccentric 36 (FIG. 2) which is connected to the lower end of the rotary drive shaft 37 of the motor. The drive shaft 37 is journaled for rotation within an upper motor bearing 38 while the eccentric 36 is supported to rotate within a lower bearing 39. As shown in FIG. 2, the bearing 39 is located within a drive cup or yoke 40 which is secured rigidly to the upper side of the shoe 12. The yoke has closed forward and rear sides 41 and open lateral sides. As a result, the yoke 40 converts rotary motion of the eccentric 36 into back and forth motion of the shoe 12 in a direction extending lengthwise of the shoe while preventing the eccentric from moving the shoe laterally.

Figure 4:
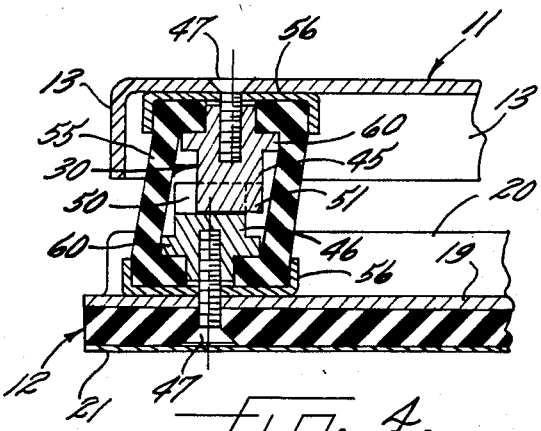
FIG. 4 is a fragmentary cross-section taken substantially along the line 4—4 of FIG. 3.

In carrying out the invention, the thrust transmitting means 30 coact with the eccentric 36 and the yoke 40 and constrain the shoe 12 to move linearly or in a straight path along the length of the shoe as the eccentric rotates. In this particular instance, there are four sets of thrust transmitting means 30, one set being located at each corner of the shoe. Each set comprises an upper cylindrical stud 45 (FIG. 5) preferably made of steel and a lower cylindrical stud 46 preferably made of a rigid, low friction material such as that sold under the trade name Synthane. The studs 45 and 46 are fastened securely to the support 11 and the shoe 12, respectively, by screws 47 (FIG. 4).

Figure 3:
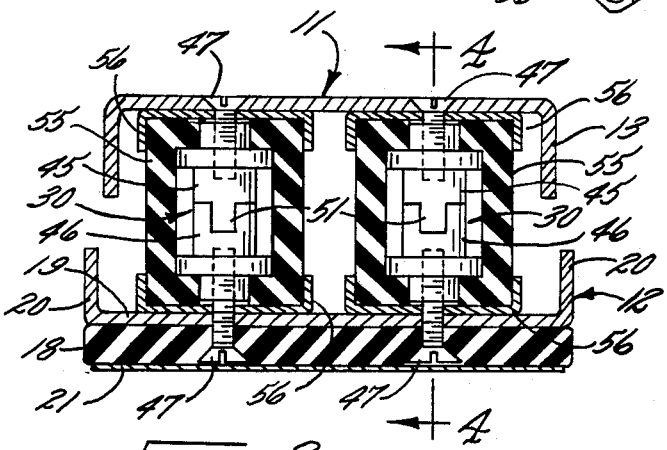
FIG. 3 is an enlarged cross-section taken substantially along the line 3—3 of FIG. 1.

The lower end of each upper stud 45 bears directly against the upper end of each lower stud 46 as shown in FIG. 3. As a result, thrust is transmitted between the support 11 and the shoe 12 by way of the studs and at four spaced locations.

Figure 5:
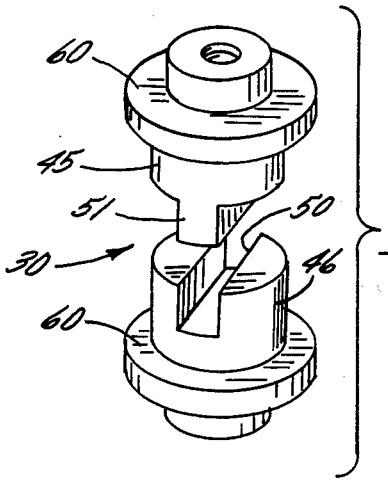
FIG. 5 is an exploded perspective view of a pair of the thrust transmitting members.

Pursuant to the invention, the studs 45 and 46 of each set 30 coact uniquely with one another to confine the shoe 12 to straight line movement. For this purpose, one of the studs of each set (herein, the lower stud 46) is formed with a groove 50 (FIG. 5). The groove opens out of the upper end of the stud 46 and slidably receives a tongue 51 formed integrally with and projecting downwardly from the lower end of the upper stud 45. All of the grooves and tongues extend in the direction of reciprocation and, as the shoe 12 is moved back and forth by the action of the eccentric 36 and the yoke 40, the grooves slide along the tongues and force the shoe to move back and forth along a linear path.

Preferably, the thrust transmitting studs 45 and 46 of each set 30 are protected by a boot 55. Each boot is a round hollow piece of rubber whose ends are adhesively secured to and seated in caps 56 (FIG. 2) which are fastened to the support 11 and the shoe 12 by the screws 47. As the shoe reciprocates, the boots flex back and forth to permit movement of the shoe. Since the boots are not required to transmit any thrust, they may be made of relatively flexible rubber so as to reduce the power necessary to reciprocate the shoe. The inner diameter of each boot is somewhat greater than the length of the stroke of the shoe so as to permit each lower stud 46 to slide freely back and forth relative to the upper stud 45.

Each stud 45 and 46 is formed with an enlarged radially extending flange 60 (FIG. 5) which helps hold the hollow interior of the boot 55 at its normal diameter and to help hold the boot in the caps 56. Each flange 60 is the same diameter as the inside diameter of the boot 55 and is spaced axially from the connected end of each stud by a distance equal to the thickness of the boot. Thus, each stud, when it is connected either to the support 11 or the shoe 12, clamps the adjacent end of the boot against the associated cap 56. Lubricant may be placed in each boot in the manner disclosed in Champayne U.S. Pat. No. 3,577,687.

From the foregoing, it will be apparent that the present invention brings to the art a new and improved rubbing machine 10 in which the studs 45 and 46 not only transmit thrust between the support 11 and the shoe 12 but also confine the shoe for reciprocation in a straight path. Because there are four sets of studs located at the four corners of the shoe, thrust on the bearings 38 and 39 is virtually eliminated and, in addition, the grooves 50 and the tongues 51 of the studs are subjected to very little wear.

I claim:

1. A rubbing machine having, in combination, a rubbing shoe, a rigid support spaced from and overlying the shoe, a drive mechanism connected between said shoe and said support and operable to move the shoe back and forth relative to the support, hollow and flexible boot means spaced angularly from one another around the drive mechanism, vertically stiff transmitting means housed within each of said boot means and connected between the support and the shoe for transmitting thrust between the support and the shoe, said thrust transmitting means including means for confining back and forth movement of said shoe to a straight path during operation of said drive mechanism.

2. A rubbing machine as defined in claim 1 in which each of said thrust-transmitting means comprises two vertically stiff and generally upright upper and lower studs positioned in end-to-end engagement, the upper and lower studs being connected rigidly to said support and said shoe, respectively, said confining means comprising a tongue projecting vertically from one end of one of said studs and toward the other stud, and a groove formed in the adjacent end of said other stud and slidably receiving said tongue, said groove and said tongue extending along said path.

3. A rubbing machine as defined in claim 2 in which said tongue is formed on the lower end of each upper stud and in which said groove is formed in the upper end of each lower stud.

4. A rubbing machine as defined in claim 1 in which said shoe is elongated and is generally rectangular and in which said drive mechanism is located approximately at the center of said shoe, said boot means comprising a pair of laterally spaced boots located adjacent one end of said shoe and further comprising an additional pair of laterally spaced boots located adjacent the opposite end of said shoe.

5. A rubbing machine as defined in claim 1 in which said drive mechanism comprises a motor connected to said support and having a downwardly extending rotary drive shaft, an eccentric connected to and adapted to be rotated by said drive shaft, and means connected between said shoe and said eccentric for converting rotary motion of said eccentric into back and forth motion of said shoe along said path while preventing said eccentric from moving said shoe laterally of said path.

6. A rubbing machine having, in combination, a generally rectangular rubbing shoe, an elongated rigid support spaced from and overlying said shoe, a drive mechanism connected between said shoe and said support and operably connected to the shoe intermediate the ends of the shoe to move the latter back and forth relative to said support, a first pair of laterally spaced, hollow and flexible boots connected between said shoe and said support adjacent one end of said shoe, a second pair of laterally spaced, hollow and flexible boots connected between said shoe and said support adjacent the other end of the shoe, thrust transmitting means housed within each boot, each of said thrust transmitting means comprising a lower rigid stud connected rigidly to said shoe and extending upwardly toward said support and further comprising an upper rigid stud connected rigidly to said support and extending downwardly toward said shoe, and means interconnecting the upper end of each lower stud to the lower end of the adjacent upper stud to transmit thrust between said support and said shoe while confining back and forth movement of said shoe to a straight path during operation of said drive mechanism.

7. A rubbing machine as defined in claim 6 in which each of said interconnecting means comprise a tongue projecting vertically from one end of one of said studs and toward the other stud, and a groove formed in the adjacent end of said other stud and slidably receiving said tongue, said groove and said tongue extending along said path.

8. A rubbing machine as defined in claim 7 in which said tongue is formed on the lower end of each upper stud and in which said groove is formed in the upper end of each lower stud.

9. A rubbing machine as defined in claim 6 in which said drive mechanism comprises a motor connected to said support and having a downwardly extending rotary drive shaft, an eccentric connected to and adapted to be rotated by said drive shaft, and means connected between said shoe and said eccentric for converting rotary motion of said eccentric into back and forth motion of said shoe along said path while preventing said eccentric from moving said shoe laterally of said path.

10. A rubbing machine having, in combination, an elongated and generally rectangular rubbing shoe, a rigid support spaced from and overlying the shoe, a drive mechanicm connected between said shoe and said support and operable to move the shoe back and forth relative to the support, and sets of thrust transmitting means located adjacent each of the four corners of said shoe, each set of said thrust transmitting means comprising a lower rigid stud connected rigidly to said shoe and extending upwardly toward said support and further comprising an upper rigid stud connected rigidly to said support and extending downwardly toward said shoe, and means interconnecting the upper end of each lower stud to the lower end of the adjacent upper stud to transmit thrust between said support and said shoe while confining back and forth movement of said shoe to a straight path during operation of said drive mechanism.

11. A rubbing machine as defined in claim 10 in which each of said interconnecting means comprise a tongue projecting vertically from one end of one of said studs and toward the other stud, and a groove formed in the adjacent end of said other stud and slidably receiving said tongue, said groove and said tongue extending along said path.

12. A rubbing machine as defined in claim 10 further including a hollow flexible boot surrounding each pair of studs and connected between said support and said shoe.

* * * * *